United States Patent [19]

Zammit

[11] Patent Number: 5,030,936

[45] Date of Patent: Jul. 9, 1991

[54] PLUNGERLESS SOLENOID CONSTRUCTION

[76] Inventor: Antony Zammit, 4 Humheller Road, Rexdale, Ontario, Canada, M9W 5K3

[21] Appl. No.: 553,614

[22] Filed: Jul. 18, 1990

[51] Int. Cl.[5] ..... H01F 7/06

[52] U.S. Cl. ..... 335/279; 335/296

[58] Field of Search ..... 335/296, 297, 259, 264, 335/279

[56] References Cited

U.S. PATENT DOCUMENTS

| | | | |
|---|---|---|---|
| 548,601 | 10/1895 | Black | 335/259 X |
| 1,562,730 | 11/1925 | Andrews | 335/278 |
| 2,881,367 | 4/1959 | Watson | 335/264 X |
| 3,376,528 | 4/1968 | Macy | 335/296 |
| 3,467,927 | 9/1969 | Macy | 335/296 |
| 3,486,147 | 12/1969 | Macy | 335/264 |
| 3,621,422 | 11/1971 | Macy | 335/264 |

*Primary Examiner*—George Harris

*Attorney, Agent, or Firm*—Shoemaker and Mattare, Ltd.

[57] ABSTRACT

A solenoid apparatus includes a plurality of plate members of which at least some are electromagnets, each of the latter including at least one toroidal coil of conductive wire. Guiding device is connected to the plate members so as to keep them in alignment, and so as to allow the plate members to separate from each other and approach each other while preventing the separation between any adjacent pair of electromagnets from exceeding a given maximum. The device includes means allowing electrical energization of the coils of conductive wire.

4 Claims, 6 Drawing Sheets

$d_1 = d_2 = d_3 = d_4 = d_5$

PLUNGERLESS SOLENOID CONSTRUCTION

This invention relates generally to solenoids, and has to do particularly with a plungerless solenoid construction which exhibits certain advantages over conventional constructions.

BACKGROUND OF THIS INVENTION

Currently, there are many different designs for solenoids, although conventional solenoids generally all consist of a magnetizable rod plunger with one end of the plunger located in an electromagnet yoke which contains windings of magnet wire in the form of a coil. When power is applied to the windings, a magnetic field or flux is created. The linked portion of this flux (i.e. linking through the plunger) causes the plunger to be attracted towards the back of the yoke through the plunger air gap. While the power is applied, the plunger will be held in the closed position by the linked flux. When the power is stopped, the magnetic attraction is released. In most constructions, a mechanical device such as a spring will then return the plunger to its original open position.

Solenoids are in widespread industrial and consumer goods use, particularly automotive and electronics, as electro-mechanical switching devices. Solenoids can be mass produced in a variety of shapes and sizes. Usually, they are reliable when new. However, with extended use, reliability is a concern. An increase in coil resistance or friction between the plunger and the yoke may easily be enough to prevent the plunger from activating to the closed position. Dirt or wear can cause the solenoid to stick. Continuous opening and closing can cause the coils and thus the plunger to heat up. The resultant thermal expansion may then lead to jamming of the solenoid. If the plunger becomes stuck in the open position, continued power can burn out the coil windings. If the solenoid fails to release to the open position, damage may be done to a connecting component which it is controlling.

In the conventional solenoid construction, a large portion of the flux generated is unlinked, and is therefore not used in the process. This results in an inefficient use of the solenoid yoke during plunger movement. Another limitation of the conventional solenoid construction is the distance of travel of the plunger. For a given solenoid size, the maximum distance of plunger travel will be a function of the amount of unlinked flux. The greater the amount of the unlinked flux, the smaller the distance of plunger travel.

Because of the above limitations, and for reasons of unreliability and safety, many designers try to minimize the use of solenoids wherever possible.

GENERAL DESCRIPTION OF THIS INVENTION

The present invention consists of a sequence of connected electromagnet plates that all contract proportionately together, when powered, to produce the equivalent of the overall throw of a conventional solenoid. The present design does not include a plunger.

More particularly, this invention provides a solenoid apparatus comprising:

a plurality of plate members, at least some of which are electromagnets, each electromagnet including at least one toroidal coil of conductive wire, each plate member having opposed parallel, flat surfaces, guiding means connected to all plate members so as to keep the plate members in substantial alignment, and so as to allow the plate members to separate from each other and approach each other while ensuring that the spacings between each adjacent pair of plate members do not exceed a given maximum, said guiding means being adapted to allow adjacent plate members to lie substantially in surface contact when they are at closest approach, said guiding means including a plurality of spacing control pins extending away from the plate members such that each pair of adjacent plate members has a first pair of spacing control pins in alignment with pins on the plate member below it, and a second pair of spacing control pins in alignment with pins on the plate member above it, and, for each pair of aligned spacing control pins, an oval link together with means for maintaining the link over the pair of spacing control pins, and means allowing the coils of conductive wire to be electrically energized.

GENERAL DESCRIPTION OF THE DRAWINGS

Four embodiments of this invention are illustrated in the accompanying drawings, in which like numerals denote like parts throughout the several views, and in which.

DETAILED DESCRIPTION OF THE DRAWINGS

Figure 1:
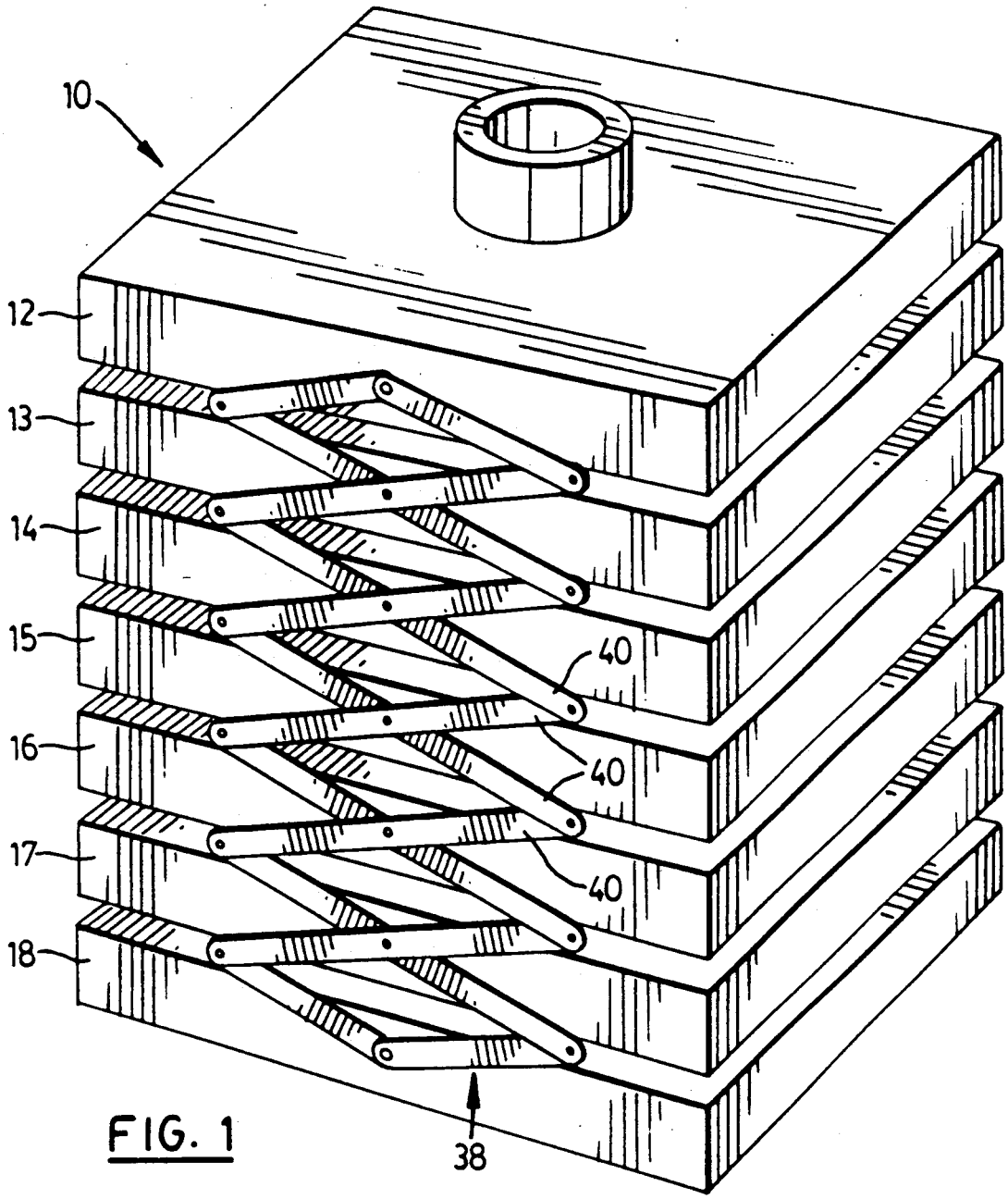
FIG. 1 is a somewhat schematic perspective view of a solenoid construction incorporating one embodiment of the present invention.

Attention is first directed to FIG. 1, which shows a solenoid 10 which consists of a plurality of individual electromagnets 12–18. The electromagnets 12 and 18 are the end electromagnets, and the others, 1317, are intermediate electromagnets.

Figure 3:
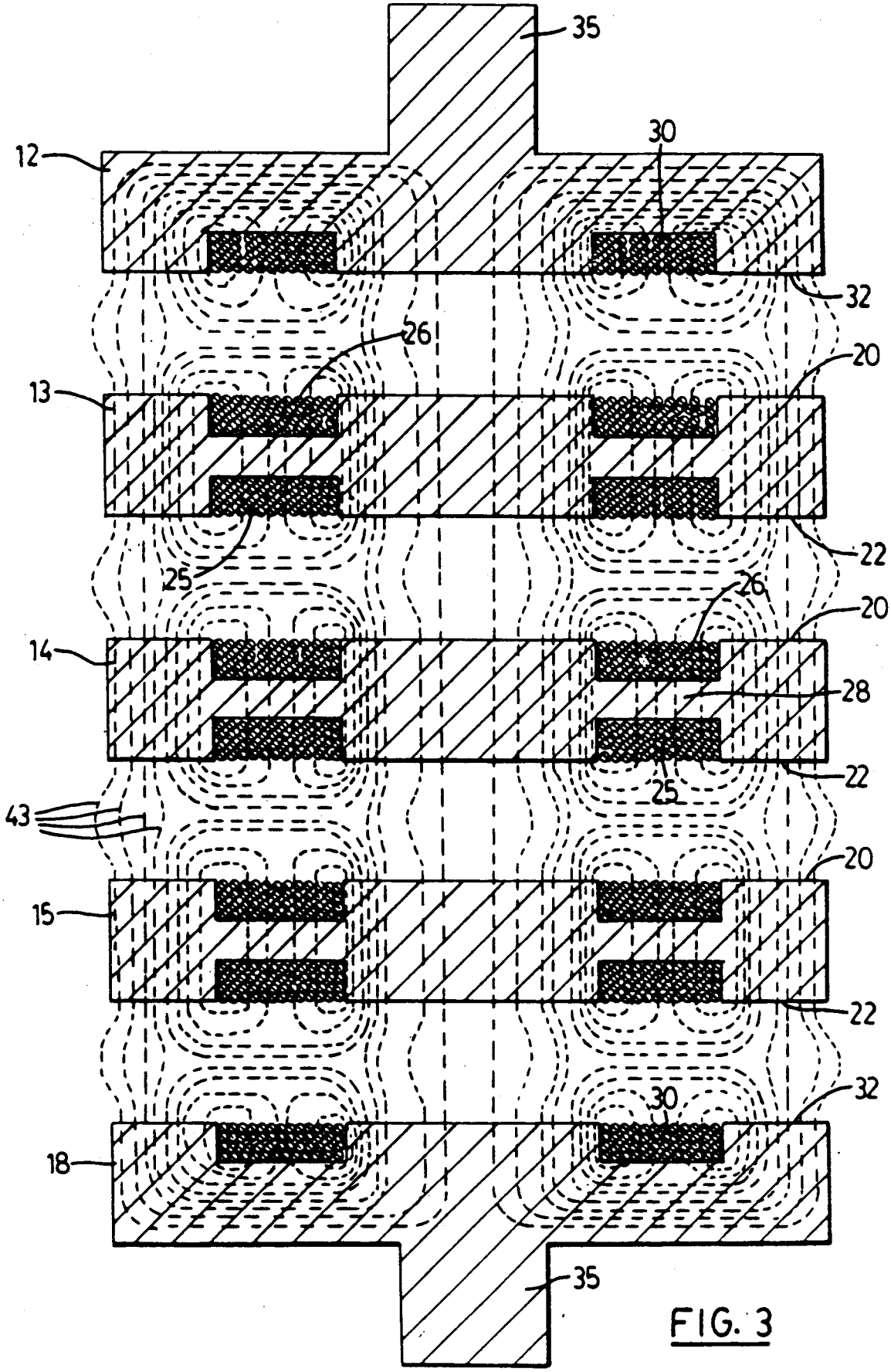
FIG. 3 is an axial sectional view of a further variant of the solenoid of FIG. 1.

Turning to FIG. 3, showing only three intermediate electromagnets 13, 14 and 15, it will be seen that each of the intermediate electromagnets is in the form of a plate member made of a ferromagnetic material such as iron and having opposed, parallel flat surfaces 20 and 22. Each intermediate electromagnet has two toroidal coils 25 and 26 in axial alignment with each other, but separated by an annulus 28 forming part of the base.

The end electromagnets 12 and 18 in FIG. 3 have only a single toroidal winding 30 each (although it would be possible to dispense with actual windings or coils in the end electromagnets, so long as they are made of ferromagnetic material). The illustrated toroidal winding 30 of each end electromagnet 12 and 18 (in FIG. 3) is recessed into the innermost surface 32 of the respective electromagnet.

Figure 2:
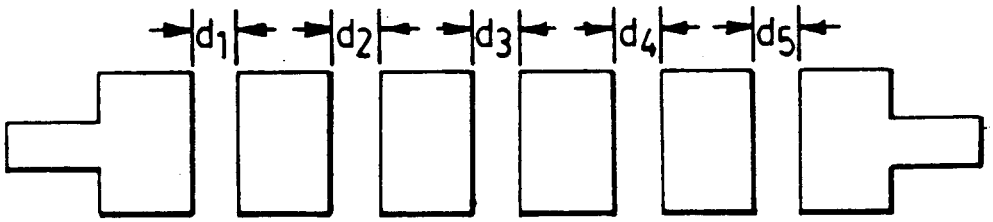
FIG. 2 is a schematic view of the various components of a variant of the FIG. 1 solenoid, illustrating the action of the device.

As can be seen in FIGS. 1-3, each end electromagnet includes an integral boss 35 of cylindrical form, to which operative members may be connected in order to make use of the longitudinal contraction and expansion of the solenoid.

Figure 5:
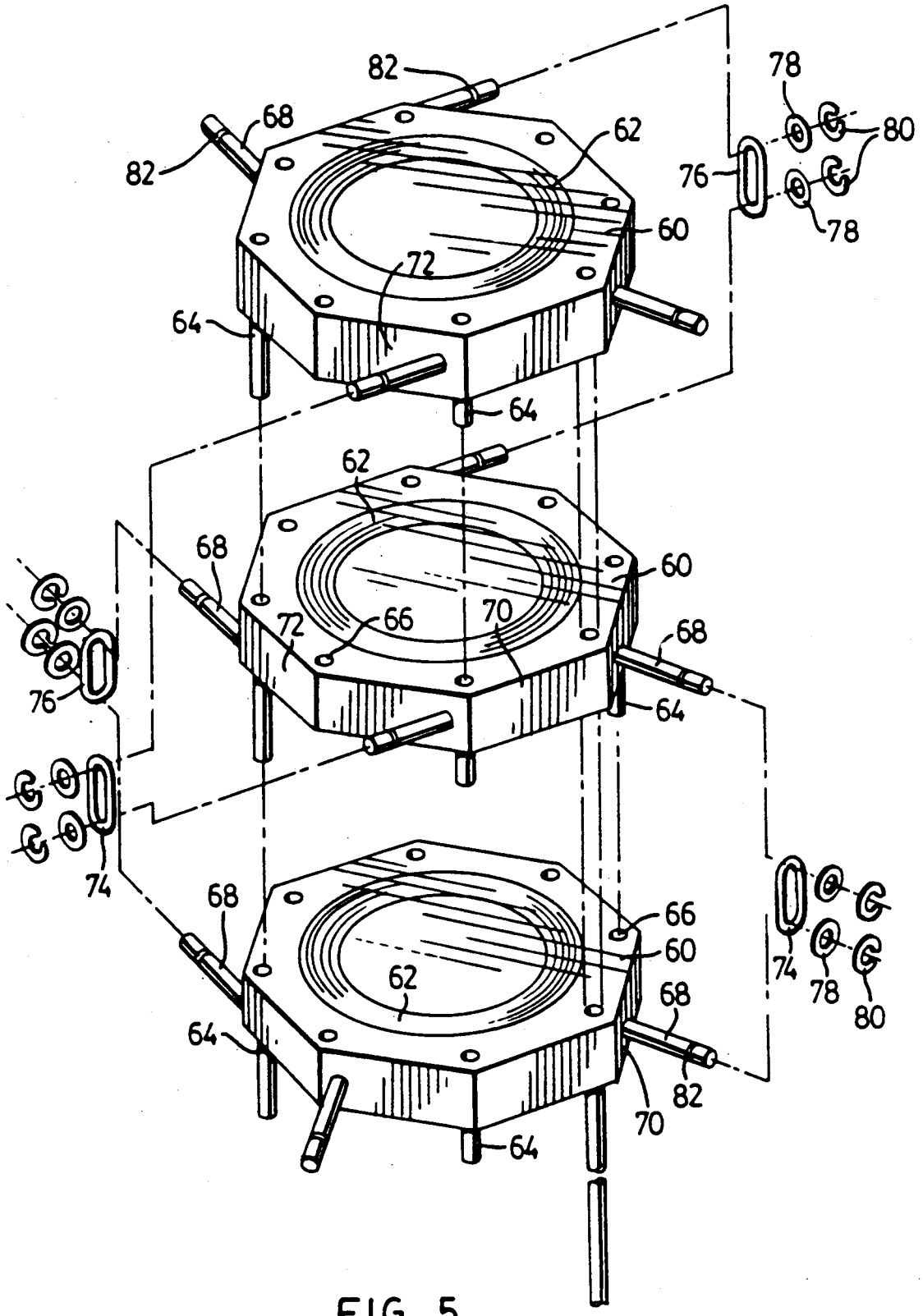
FIG. 5 is a perspective view of a solenoid construction incorporating a second embodiment of the present invention.

Returning to FIG. 1, it will be noted that the apparatus includes a spacing mechanism 38 consisting of a plurality of pairs of links 40, which pairs are centrally pivoted to each other with the end points of each pair being pivotally connected to adjacent pairs. The spacing mechanism 38 is preferably made from a nonmagnetic material, so that it will not draw any of the flux travelling through the outer portions of the electromagnets. In this specification and in the appended claims, the mechanism illustrated in FIG. 1 will be referred to as a scissors-effect device. Wherever X-related pairs of the links 40 are pivoted to each other there is provided a pivotal connection to one of the electromagnets 12-18. The electromagnet is thus free to pivot about its connection to the respective pair of links. Such pivoting motion, however, can be limited by ensuring that the overall "expanded" length of the unit is limited. No limiting mechanism is shown in FIG. 1, but a suitable such mechanism is shown in FIG. 5 (which will be described later in this specification).

In FIG. 1, only a single spacing mechanism 38 is visible, although it will be understood that there would be provided at least one additional spacing mechanism on the opposite side. Also, it is conceivable that more than two such spacing mechanisms 38 could be provided. For example, it would be possible to use four such spacing mechanisms, one on each side face of the various electromagnets.

FIG. 3 includes flux lines 43, which show how the magnetic flux is linked within the windings, within the plate members, and in the air gaps between the plate members.

Figure 4:
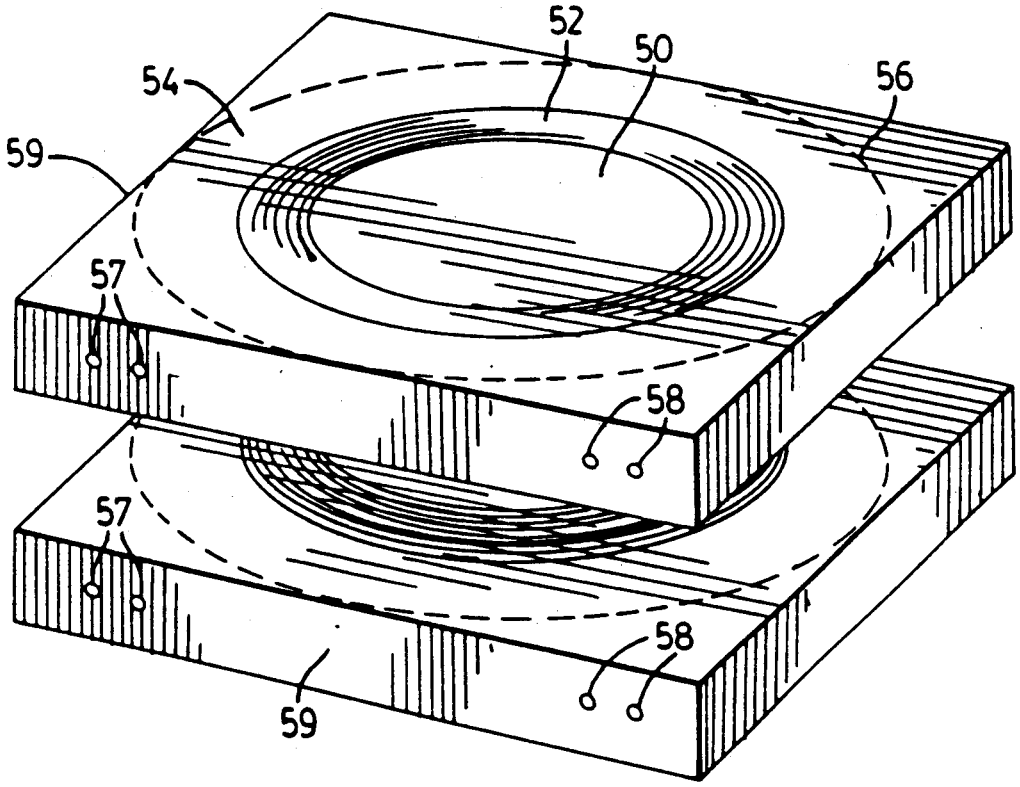
FIG. 4 is a perspective view of two adjacent electromagnets of the present invention.

As in the conventional solenoid design, the area of the outside contracting surface or pole face is made equal to the area of the inside pole face. This is illustrated in FIG. 4 which shows the centre pole face 50, the toroidal winding 52 and the outside pole face 54 on the upper plate member in the figure. The broken line 56 shows the minimum required outer radius for the outside pole. Material of the square electromagnet which lies outside the broken line 56 is not required to attain the magnetic field desired within the solenoid. Also in FIG. 4, terminals 57 and 58 on each plate member 59 are connected to the ends of the two toroidal windings 52 supported by the plate member. The terminals 57 and 58 constitute means allowing the coils of conductive wire (windings 52) to be electrically energized.

In one preferred design, the maximum possible separation between the individual electromagnets is the same for all the constituent electromagnets. In other words, the magnets are all equally spaced, as is indicated in FIG. 2. The function of the scissors-effect device shown at 38 in FIG. 1 is to maintain the individual electromagnets equally spaced from each other, during contraction and expansion.

Attention is now directed to FIG. 5, which shows an alternative embodiment of the invention.

In FIG. 5 are shown three plate members 60 which are octagonal. The plate members 60 are shown spaced from one another, and each is an electromagnet which incorporates two toroidal coils 62 (only one of each coil visible for each plate member 60).

The embodiment of FIG. 5 does not use a scissor-effect device to maintain the plate members with respect to each other. Instead, each plate member 60 incorporates four guide pins 64 which extend in the axial direction with respect to the plate members 60, and are adapted to be received slidingly in appropriately sized bores 66 in the plate member 60 next below.

In order to control spacing between the plate members (and to ensure that the pairs of adjacent plate members 60 do not separate from each other far enough to cause the guide pins 64 to come fully out of the corresponding bores 66), some form of restraining mechanism must be provided. In FIG. 5, it can be seen that each plate member incorporates four spacing control pins 68 which project perpendicularly away from corresponding facets of the octagonal periphery, in a direction which is parallel with the plane of the respective plate member 60. It will further be noted in FIG. 5 that adjacent pairs of the plate members 60 have two of their pins 68 in the same position (aligned axially with respect to the axis of the solenoid). For example, the lower two plate members 60 in FIG. 5 have aligned spacing control pins 68 projecting to the right from facets 70, and projecting to the left from the facets diametrically opposed to the facets 70. Likewise, the upper two plate members 60 have aligned pins projecting from the corresponding facets 72, and also from the facets opposed to the facets 72. These pairs of aligned spacing control pins are adapted to receive links 74 which are oval in shape, and define an internal slot 76 which is sized so as to snugly but slidingly receive pairs of the spacing control pins 68.

To assemble the portions shown in FIG. 5, the different plate numbers 60 are placed in contact with each other, and the links 74 are slipped over correspondingly positioned spacing control pins 68, each link 74 joining two of the spacing control pins 68. Then, two washers 78 are slipped over the spacing control pins, and C-clips 80 are snapped into the appropriate groove 82 in the spacing control pin 68, in order to retain the washer 78 and link 74 against the surface of the respective facet (for example the facet 70). Because the link 74 connects the two spacing control pins of adjacent plate members 60, the latter are limited in the degree to which they can separate from each other. The link 74 is sized in such a way that it ensures that the guide pins 64 cannot be fully removed from the corresponding bores 66.

As a variant of the invention described above, it should be noted that one or more of the intermediate plate members may not contain toroidal coils, or may contain coils wound from a magnetic material, for example steel. A construction of this kind would allow the length of contraction to be more fully controlled. Supposing that one of these different types of intermediate plate member were to replace every n'th electromagnet, it will be possible to control the length of contraction of the solenoid up to any one of these special plate members. By using plate members with coils wound from magnetic material (instead of solid plate members without coils), the replacement plate members could still be used to create a magnetic field, if desired.

As a further variant, it should be noted that the end electromagnets do not necessarily have to contain coils. They may simply be made as a solid piece of ferromagnetic material.

A further variant may include an expandable rubber sleeve which is accordionated to allow it to expand and contract along with the solenoid. This sleeve could be attached to the end plates, and would function to prevent the entry of dust or other materials into the spaces between the plate members.

Figure 6:
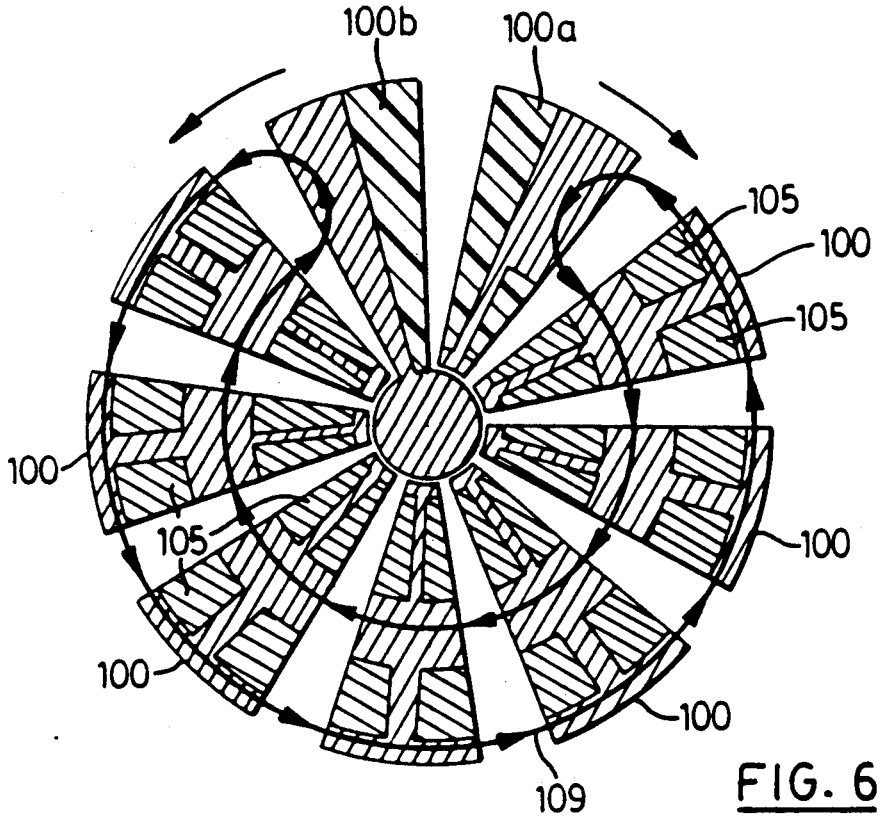
FIG. 6 is a cross-sectional view through a circular embodiment of this invention, with various sectors in separated conditions.
Figure 7:
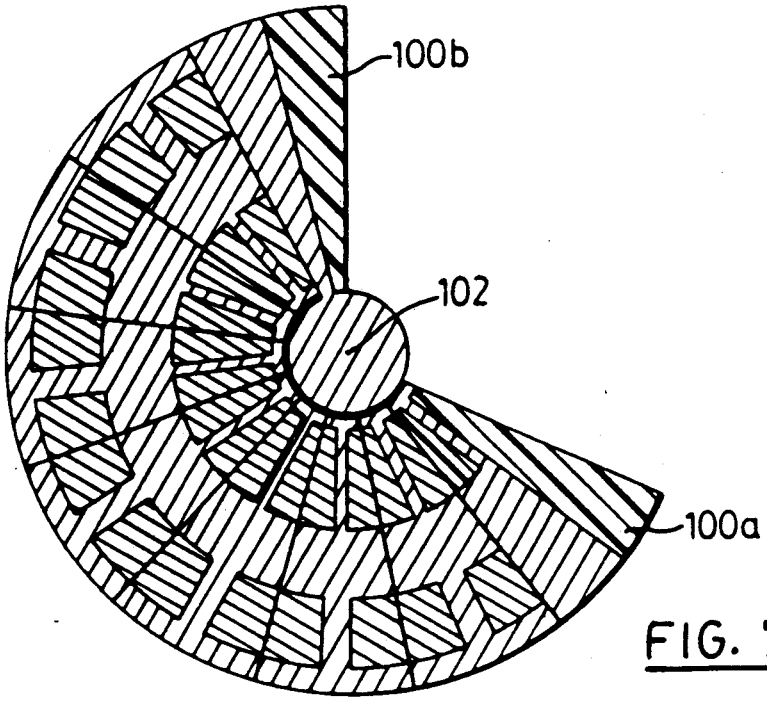
FIG. 7 is a view similar to FIG. 6, showing the sectors in collapsed condition.

Attention is now directed to FIGS. 6 and 7 which illustrate a variation of the plungerless solenoid in which the electromagnets are distributed radially in a circular geometry. In this embodiment, each plate member 100 resembles a circular sector in cross-section, and all plate members 100 are mounted about a main axis 102 with which the centres of curvature of all plate members 100 coincide.

In FIG. 6, the plate member 100*a* may be fixed to an external anchor, while the plate member 100*b* is intended to be connected to a shaft which undergoes rotation with respect to the external anchor when the solenoid is activated. Thus, the plate member 100*a* and 100*b* correspond to the end plate members in the earlier embodiments. In FIG. 6, the shaded areas 105 show the disposition of electromagnetic coils, and it will be seen that, in a particular embodiment of FIGS. 6 and 7, each plate member with the exception of the "end" plate members 100*a* and 100*b* contain two coils each.

In FIG. 6, a closed loop 109 with arrowheads shows the pathway of the main magnetic flux linking the different plate members 100. If the various sectors are initially in the configuration shown in FIG. 6, and power is applied to the various coils 105, the linking magnetic flux will seek to contract the various plate members together into a configuration such as that shown in FIG. 7. It will be understood that, if one of the end plate members is fixed (such as 100*a* in FIG. 6), it would not change its radial position during contraction of the other plate members.

If desired, spacing control pins (not illustrated) could be affixed to the various plate members. Such pins could be placed either around a circumference and on both ends, or just on both ends.

It is considered important that the mating surfaces of the various plate members have a smooth, bearing-like surface.

Figure 8:
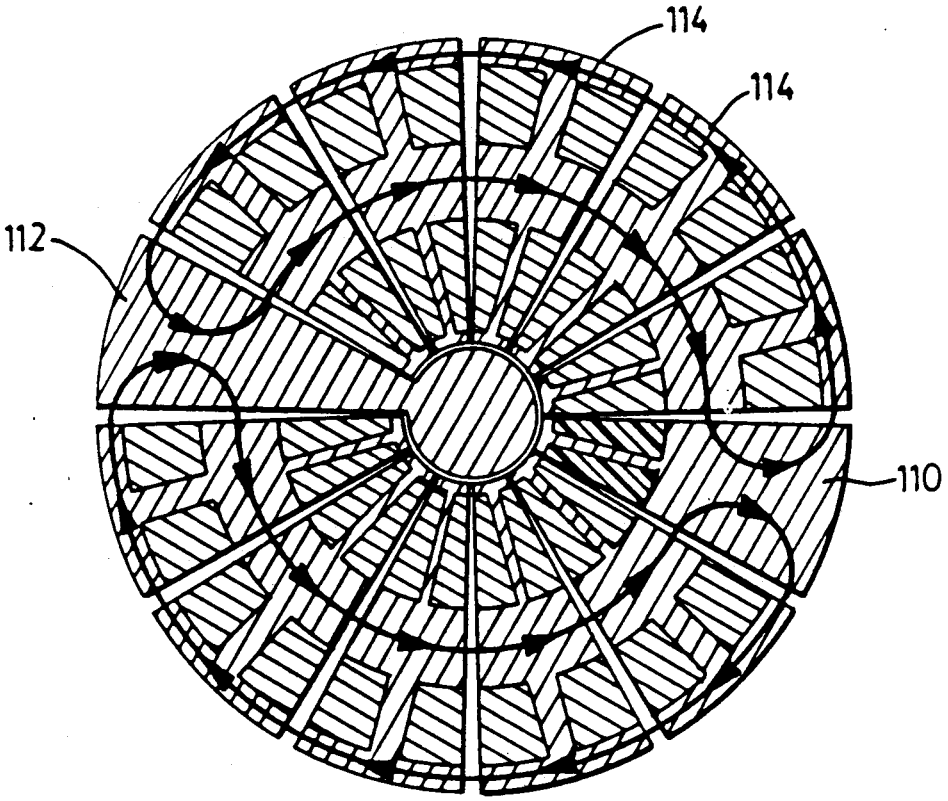
FIG. 8 is a cross-sectional view through a variant of the embodiment of FIGS. 6 and 7.

The solenoid shown in the contracted position of FIG. 7 can be returned to its open position (FIG. 6) in any of several ways. Firstly, a spring coiled about the shaft and attached to the shaft at one end and to the external object at the other, could be utilized. Alternatively, a second solenoid with the same geometry could be employed, the second solenoid contracting in the opposite direction and being placed on top (i.e. in axial alignment) with be first solenoid. Thirdly, the arrangement of plate numbers could be changed to allow contraction in either direction, this being shown in FIG. 8 as a variant. In FIG. 8, the plate members 110 and 112 are the end members, and are approximately diametrally displaced from one another. Between the two end plate members, around both directions, there is a plurality of electromagnets 114 identical to the members 100 shown in FIG. 6. It will be obvious that, for example, if the end electromagnet 110 is fixed to external anchor, the other end electromagnet 112 can be made to move either clockwise or counterclockwise from the position illustrated in FIG. 8, by energizing one or the other group of intermediate electromagnets 114.

It is important to understand that the relative proportions of each of the different parts of an individual electromagnet in the embodiments shown in FIGS. 6–8 may be somewhat different than for the embodiments described with respect to earlier Figures (the linear variant of the solenoid), however all of the properties and benefits inherent to the linear geometry would also apply to the circular geometry of FIGS. 6–8.

The circular solenoid can find use in applications where it is desired to turn a shaft through some angle. With a single such solenoid arrangement, the angle must be less than one complete turn, however, several such solenoids could be stacked upon one another and connected in such a manner that their contracting angles add up to more than one complete turn. The circular solenoid would be particularly attractive for applications requiring the turning of a shaft through some angle where it is very difficult to turn the shaft, i.e. it requires a lot a force, and/or where the shaft must be turned very quickly. One such application is as an actuator for a ball or butterfly valve where the shaft needs to be rotated through only 90°, taking a large force to accomplish the rotation. Further, if the circular solenoid is constructed such that it is able to contract any amount up to the n'th electromagnet, then the amount that the ball valve is opened or closed may be controlled accurately and quickly.

The present solenoid construction exhibits the following advantages with respect to the conventional solenoid of the prior art.

The total attracting pole face area is approximately twice that of a plunger solenoid. Thus, for the same cross-sectional area, the solenoid described herein will achieve twice the force of attraction. Conversely, for a given force of attraction, the design described herein allows the circular area of the solenoid to be less than that required by conventional designs.

The effective amount of unlinked flux (i.e. the amount lost on one air gap of one electromagnets in the present design) is substantially smaller than the conventional design (the amount lost on the plunger air gap) due to the minimization of fringing. This leads to a more efficient use of the solenoid's core.

The length of the stroke or throw of the solenoid described herein is not limited by the unlinked flux in the plunger air gap, as is the case in existing solenoids. The number of electromagnets can be increased to give a longer throw than is possible with the conventional design.

The almost complete utilization of the magnetic flux and the elimination of critical moving parts (the plunger) that have minimal clearance will contribute to a more reliable operation. The solenoid of the present invention is more robust than the solenoids of the prior art, thus resulting in a solenoid with a longer life span.

Finally, the present invention allows for better heat dissipating than can be achieved by conventional designs, due to the fact that there is more exposed surface area, most of which has air rushing past it when the solenoid is contracting or expanding.

While several embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A solenoid apparatus comprising:

a plurality of plate members, at least some of which are electromagnets, each electromagnet including at least one toroidal coil of conductive wire, each plate member having opposed parallel, flat surfaces, guiding means connected to all plate members so as to keep the plate members in substantial alignment, and so as to allow the plate members to separate from each other and approach each other while ensuring that the spacings between each adjacent pair of plate members do not exceed a given maximum, said guiding means being adapted to allow adjacent plate members to lie substantially in surface contact when they are at closest approach, said guiding means including a plurality of spacing control pins extending away from the plate members such that each pair of adjacent plate members has a first pair of spacing control pins in alignment with pins on the plate member below it, and a second pair of spacing control pins in alignment with pins on the plate member above it, and, for each pair of aligned spacing control pins, an oval link together with means for maintaining the link over the pair of spacing control pins, and means allowing the coils of conductive wire to be electrically energized.

2. A solenoid apparatus comprising:

a plurality of plate members, at least some of which are electromagnets, each electromagnet including at least one toroidal coil of conductive wire, each plate member resembling a circular sector in cross-section, all plate members being mounted about a main axis with which the centers of curvature of all plate members coincide, at least one plate member being restrained against rotary movement about the main axis, at least some of the remaining plate members being mounted for rotational movement about said main axis, the restrained plate member and one of said remaining plate members constituting end plate members, each electromagnet incorporating ferromagnetic material into which said at least one coil is recessed, each coil having a coil axis, the guiding means being constituted in part by the mounting of said plate members about said main axis so that said coil axes remain on a hypothetical circle centered on said main axis, and means allowing the coils of conductive wire to be electrically energized.

3. The apparatus claimed in claim 1, further including a plurality of guide pins extending in an axial direction with respect to the solenoid apparatus, each guide pin being secured to one of the plate members, and sliding longitudinally in an appropriately positioned bore on another of the plate members.

4. The apparatus claimed in claim 2, in which each plate member has opposed flat surfaces converging toward said main axis, said guiding means being adapted to allow adjacent plate members to lie substantially in surface contact when they are at closest approach.

* * * * *